US012504217B2

(12) United States Patent
Burns et al.

(10) Patent No.: US 12,504,217 B2
(45) Date of Patent: Dec. 23, 2025

(54) INSULATED STRUCTURE FOR A REFRIGERATION UNIT

(71) Applicant: WHIRLPOOL CORPORATION, Benton Harbor, MI (US)

(72) Inventors: John Joseph Burns, St. Joseph, MI (US); Jackson Felipe Karl, Stevensville, MI (US); Marcel Bögger Lessa, Joinville (BR); Dustin Michael Miller, South Bend, IN (US); Sanket Vivek Phalak, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 134 days.

(21) Appl. No.: 18/365,300

(22) Filed: Aug. 4, 2023

(65) Prior Publication Data

US 2025/0044015 A1 Feb. 6, 2025

(51) Int. Cl.
*F25D 23/02* (2006.01)

(52) U.S. Cl.
CPC ..... *F25D 23/02* (2013.01); *F25D 2201/14* (2013.01)

(58) Field of Classification Search
CPC ..... F25D 23/02; F25D 23/028; F25D 2201/14
See application file for complete search history.

(56) References Cited

U.S. PATENT DOCUMENTS 3,627,165 A 12/1971 Cobb
6,926,379 B1 * 8/2005 Grace ..... F25D 23/028 312/401
9,279,609 B2 * 3/2016 Kim ..... F25D 23/087
9,879,900 B1 * 1/2018 Ammerman ..... F25D 23/04
9,885,202 B2 2/2018 Laible
10,697,699 B2 6/2020 Krishna et al.
11,320,193 B2 5/2022 Visin et al.
2008/0172838 A1 7/2008 Choi
2016/0258671 A1 * 9/2016 Allard ..... F25D 23/085
2017/0370632 A1 * 12/2017 Jeong ..... F25D 23/062
2019/0003762 A1 * 1/2019 Choi ..... F25D 17/04
2019/0128593 A1 5/2019 Deka et al.
2019/0308393 A1 * 10/2019 Allard ..... B32B 15/00
2020/0141628 A1 5/2020 Krishna et al.
2020/0348072 A1 * 11/2020 Allard ..... F25D 23/02
2021/0231363 A1 7/2021 Dehury et al.
2021/0348831 A1 11/2021 Kapure et al.
2022/0235997 A1 * 7/2022 Kim ..... F25D 23/062
2022/0400851 A1 * 12/2022 Harikrishnasamy .... F25D 23/10
2023/0078837 A1 * 3/2023 Ekshinge ..... F25D 23/02 52/784.15
2023/0400245 A1 * 12/2023 Son ..... B29C 44/18

FOREIGN PATENT DOCUMENTS

WO WO-2023119690 A1 * 6/2023

* cited by examiner

*Primary Examiner* — Andrew Roersma
(74) *Attorney, Agent, or Firm* — Price Heneveld LLP

(57) ABSTRACT

An insulated structure for a refrigeration unit includes an outer wrapper, at least one bracket coupled to the outer wrapper and having at least one locator pin that extends outward therefrom, an inner liner, and a trim breaker coupled to and extending between the outer wrapper and the inner liner, such that the outer wrapper, the inner liner, and the trim breaker cooperate to define an interior volume for receiving insulation material therein. The trim breaker includes at least one alignment tab that defines a receiver that receives the at least one locator pin therein.

14 Claims, 8 Drawing Sheets

INSULATED STRUCTURE FOR A REFRIGERATION UNIT

BACKGROUND OF THE DISCLOSURE

The present disclosure generally relates to an insulated structure for a refrigeration unit. More specifically, the present disclosure relates to an insulated structure that includes an outer wrapper, an inner liner, and a trim breaker.

SUMMARY OF THE DISCLOSURE

According to one aspect of the present disclosure, an insulated structure for a refrigeration unit includes an outer wrapper, at least one bracket coupled to the outer wrapper and having at least one locator pin that extends outward therefrom, an inner liner, and a trim breaker coupled to and extending between the outer wrapper and the inner liner, such that the outer wrapper, the inner liner, and the trim breaker cooperate to define an interior volume for receiving insulation material therein. The trim breaker includes at least one alignment tab that defines a receiver that receives the at least one locator pin therein.

According to another aspect of the present disclosure, an insulated structure for a refrigeration unit includes an outer wrapper, an inner liner, at least one bracket coupled to at least one of the outer wrapper and the inner liner and having first and second locator pins that extend outward therefrom, and a trim breaker coupled to and extending between the outer wrapper and the inner liner, such that the outer wrapper, the inner liner, and the trim breaker cooperate to define an interior volume for receiving insulation material therein. The trim breaker includes a first alignment tab that defines a receiver that receives the first locator pin, a second alignment tab that defines a receiver that receives the second locator pin, and a reference tab that does not define a receiver that receives a locator pin therein. The reference tab is aligned with the first alignment tab in a first direction and is aligned with the second alignment tab in a second direction that is perpendicular to the first direction.

According to yet another aspect of the present disclosure, an insulated structure for a refrigeration unit including an outer wrapper, an inner liner, at least one bracket coupled to at least one of the outer wrapper and the inner liner and having at least one alignment feature that extends outward therefrom, and a trim breaker coupled to and extending between the outer wrapper and the inner liner, such that the outer wrapper, the inner liner, and the trim breaker cooperate to define an interior volume for receiving insulation material therein. The trim breaker includes at least one corresponding alignment feature that is engaged with the at least one alignment feature.

These and other features, advantages, and objects of the present disclosure will be further understood and appreciated by those skilled in the art by reference to the following specification, claims, and appended drawings.

Figure 1:
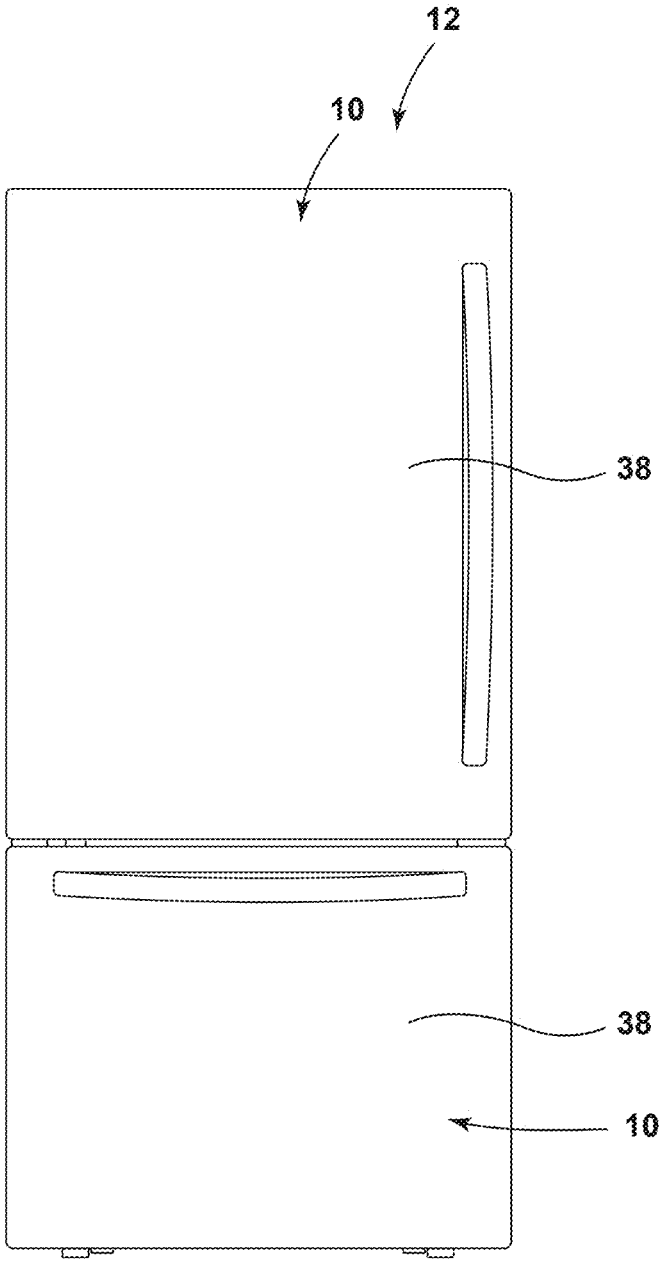
FIG. 1 is a front elevational view of a refrigeration unit that includes a door.

The components in the figures are not necessarily to scale, emphasis instead being placed upon illustrating the principles described herein.

DETAILED DESCRIPTION

The present illustrated embodiments reside primarily in combinations of apparatus components related to an insulated structure for a refrigeration unit. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that an article or apparatus that comprises a list of elements does not include only those elements but may include other elements not expressly listed or inherent to such article or apparatus. An element preceded by "comprises a . . . " does not, without more constraints, preclude the existence of additional identical elements in the article or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

In this document, relational terms, such as "first" and "second," "top" and "bottom," and the like, are used solely to distinguish one entity or action from another entity or action, without necessarily requiring or implying any actual such relationship or order between such entities or actions.

For purposes of this disclosure, the term "coupled" (in all of its forms: couple, coupling, coupled, etc.) generally means the joining of two components (electrical or mechanical) directly or indirectly to one another. Such joining may be stationary or movable in nature. Such joining may be achieved with the two components (electrical or mechanical) and/or any additional intermediate members. Such joining may include members being integrally formed as a single unitary body with one another (i.e., integrally coupled) or may refer to joining of two components. Such joining may be permanent in nature, or may be removable or releasable in nature, unless otherwise stated.

The terms "substantial," "substantially," and variations thereof as used herein are intended to note that a described feature is equal or approximately equal to a value or description. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-9, reference numeral 10 generally designates an insulated structure 10 for a refrigeration unit 12. The insulated structure 10 includes an outer wrapper 14, at least one bracket 16 coupled to the outer wrapper 14 and having at least one locator pin 18 extending outward therefrom, an inner liner 20, and a trim breaker 22. The trim breaker 22 is coupled to and extends between the outer wrapper 14 and the inner liner 20, such that the outer wrapper 14, the inner liner 20, and the trim breaker 22 cooperate to define an interior volume 24 for receiving insulation material 26 therein. The trim breaker 22 includes at least one alignment tab 28 that defines a receiver 30 that receives the at least one locator pin 18 therein.

Figure 2:
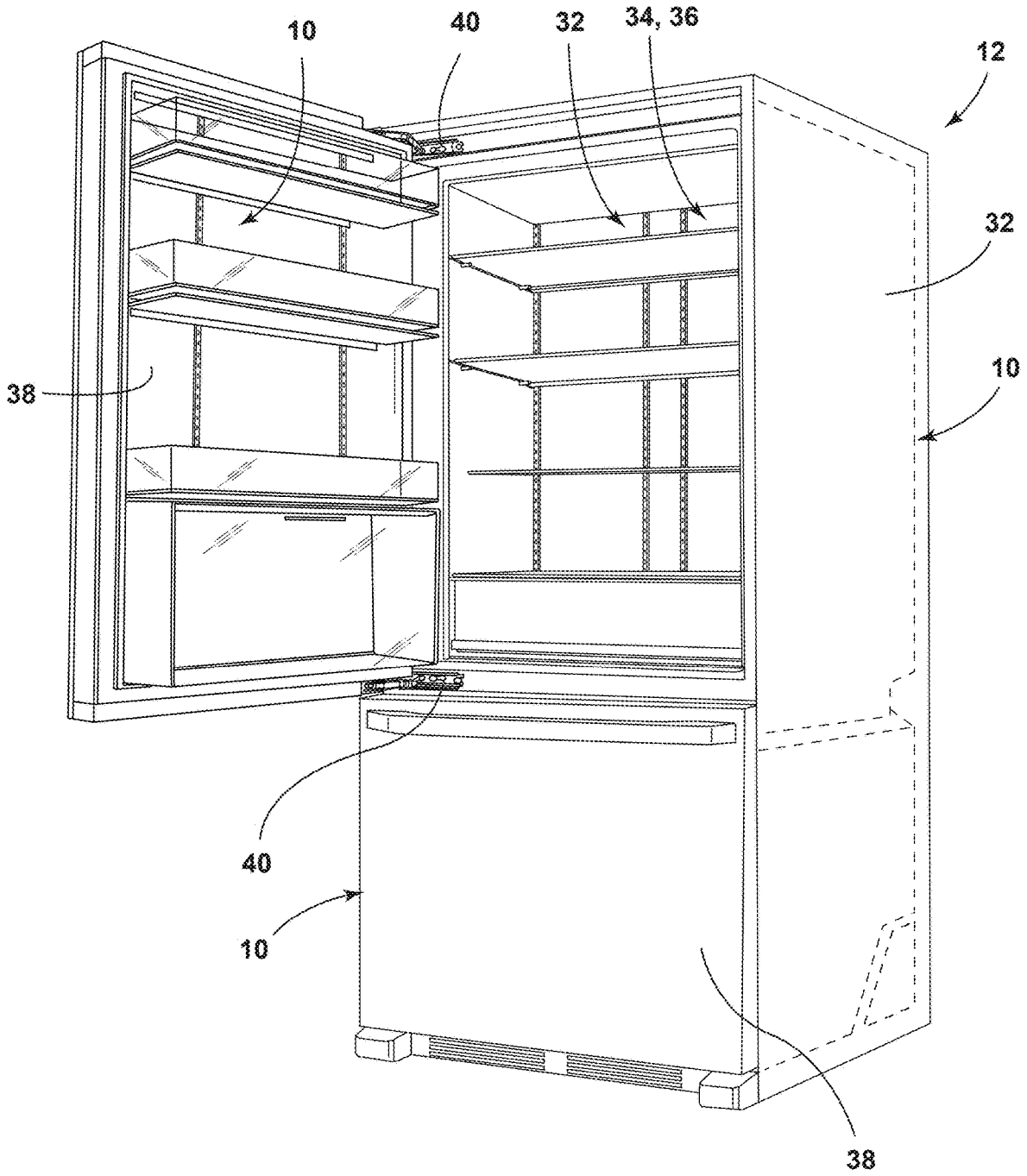
FIG. 2 is a side perspective view of a refrigeration unit illustrating a door in an open position.

Referring now to FIGS. 1 and 2, the refrigeration unit 12 is illustrated. The refrigeration unit 12 includes a cabinet 32. The cabinet 32 defines a storage compartment 34 that is configured to receive perishable items therein for refrigeration. In various implementations, the cabinet 32 defines a plurality of storage compartments 34, such as a refrigeration compartment 36, as illustrated in FIG. 2, and a freezer compartment (not shown).

Referring still to FIGS. 1 and 2, the refrigeration unit 12 includes a door 38. The door 38 of the refrigeration unit 12 is operably coupled to the cabinet 32 and configured to selectively cover an opening to the storage compartment 34 of the cabinet 32. In some implementations, the door 38 of the refrigeration unit 12 can be pivotably coupled to the cabinet 32 via a hinge 40. It is contemplated that the door 38 can be pivotally coupled to the cabinet 32 via a plurality of hinges 40, in some embodiments. The door 38 may be operable to pivot between a closed position, wherein the door 38 conceals the storage compartment 34 of the refrigeration unit 12, as illustrated in FIG. 1, and an open position, wherein access to the storage compartment 34 is provided, as illustrated in FIG. 2. In various implementations, the refrigeration unit 12 may include a plurality of doors 38. For example, in the embodiment illustrated in FIGS. 1 and 2, the refrigeration unit 12 includes two doors 38 that are configured to selectively provide access to the refrigeration compartment 36 and the freezer compartment of the refrigeration unit 12.

Figure 9:
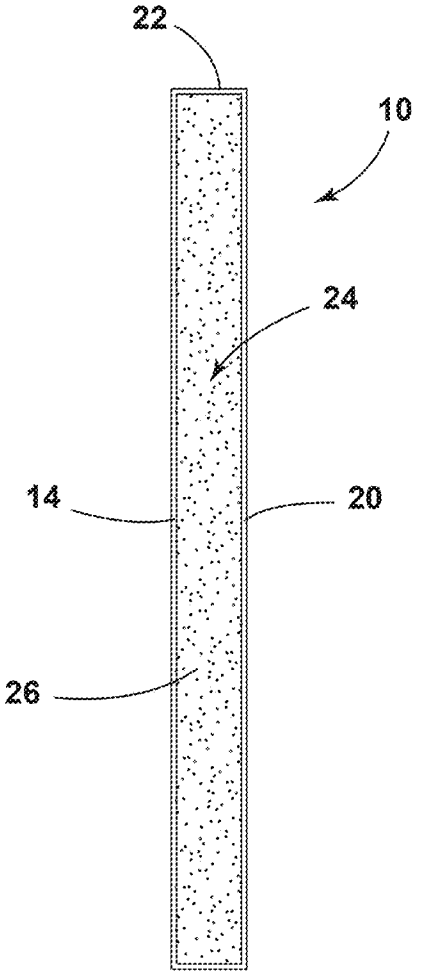
FIG. 9 is a cross-sectional view of an exemplary insulated structure illustrating an interior volume of the insulated structure and insulation material disposed within the interior volume.

Referring now to FIGS. 1-4 and 9, the refrigeration unit 12 includes the insulated structure 10. The insulated structure 10 may be and/or form a portion of a variety of components of the refrigeration unit 12. For example, the insulated structure 10 may be the cabinet 32 and/or a portion of the cabinet 32 of the refrigeration unit 12. The insulated structure 10 may be the door 38 and/or a portion of the door 38 of the refrigeration unit 12, in various implementations. For example, the insulated structure 10 may be a door panel 42 of the refrigeration unit 12, in some implementations. It is contemplated that the refrigeration unit 12 may include a plurality of insulated structures 10, in various embodiments. The insulated structure 10 defines the interior volume 24 that is configured to receive insulation material 26 therein, as illustrated in FIG. 9. A variety of types of insulation material 26 are contemplated (e.g., powder, foam, etc.). In various embodiments, the insulated structure 10 is a vacuum insulated structure 10. As such, the interior volume 24 of the insulated structure 10 is filled with insulation material 26 and then evacuated to form a sealed environment with exemplary insulative qualities. In the embodiment illustrated in FIGS. 3 and 4, the insulated structure 10 is a vacuum insulated door panel 42 of the refrigeration unit 12.

Figure 3:
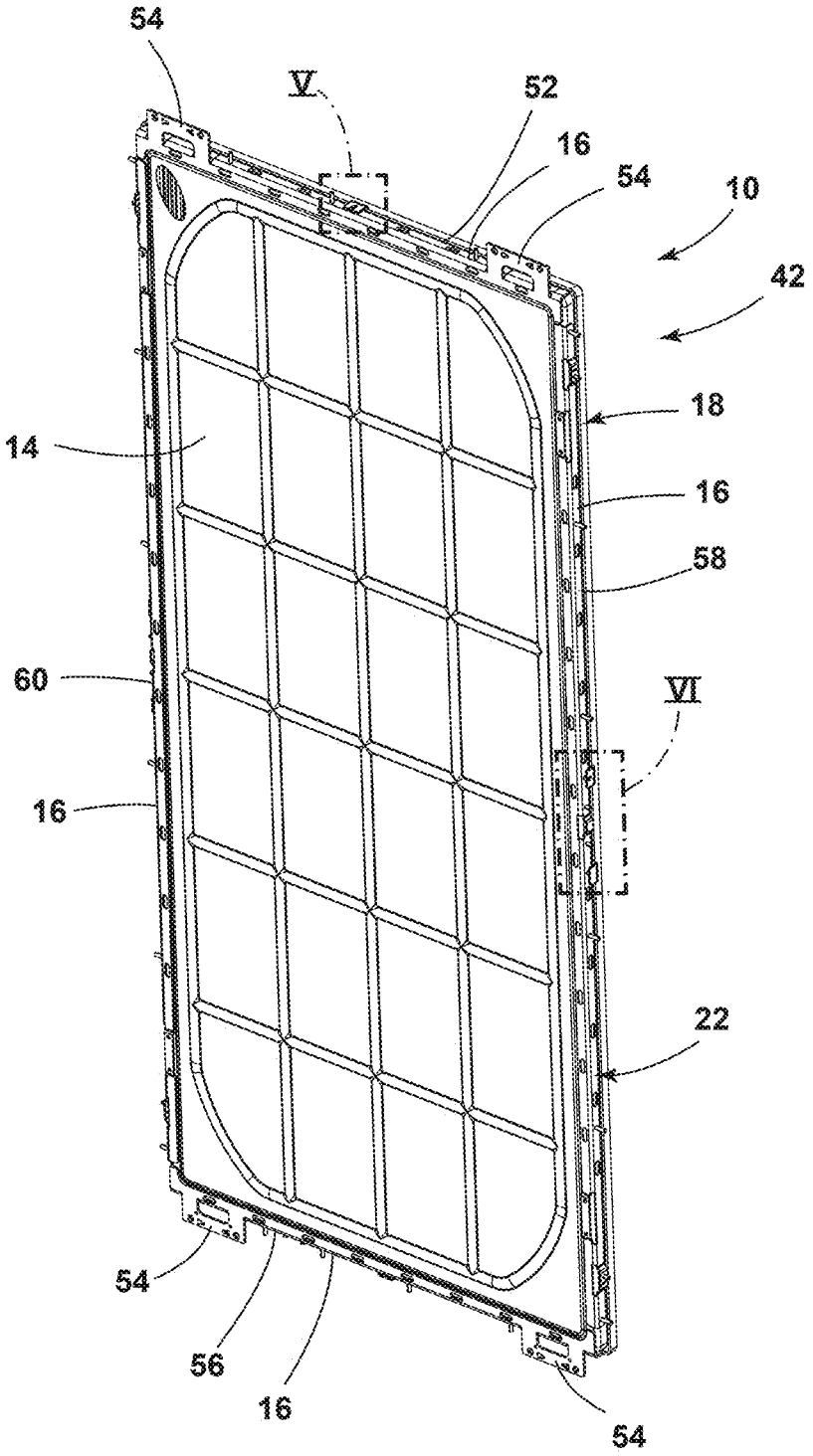
FIG. 3 is a top perspective view of an insulated structure for a refrigeration unit that includes an outer wrapper, an inner liner, a trim breaker, and a plurality of brackets.
Figure 4:
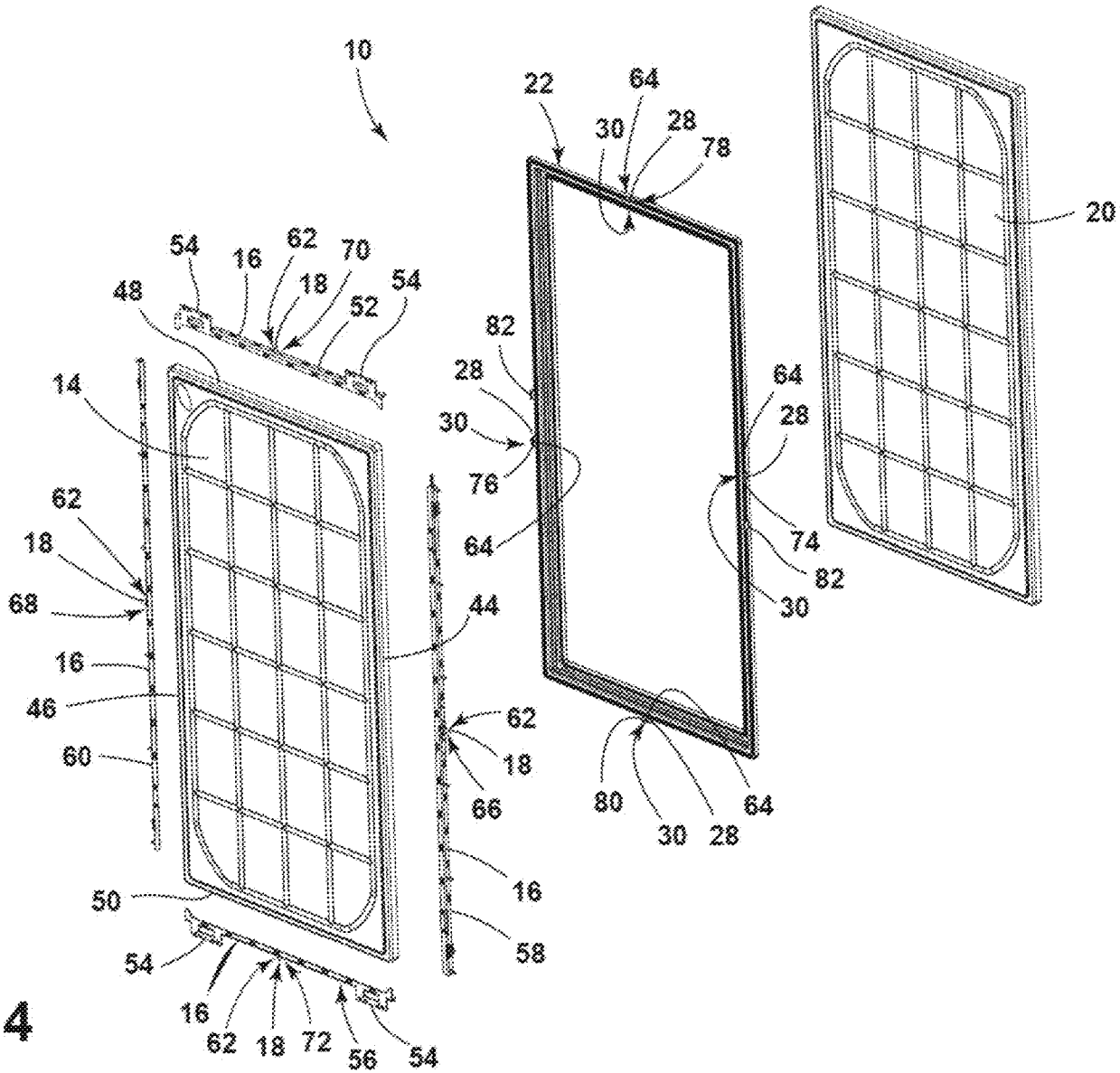
FIG. 4 is an exploded perspective view of the insulated structure of FIG. 3 illustrating the outer wrapper, the inner liner, the plurality of brackets that include a plurality of alignment features, and the trim breaker that includes a plurality of corresponding alignment features.

Referring now to FIGS. 3-8, the insulated structure 10 includes the outer wrapper 14, the inner liner 20, and the trim breaker 22 that extends between and is coupled to the outer wrapper 14 and the inner liner 20. As illustrated in FIG. 4, the outer wrapper 14 includes a first side 44, a second side 46 opposite the first side 44, a top side 48, and a bottom side 50 opposite the top side 48. In the embodiment illustrated in FIG. 4, the first and second sides 44, 46 are lateral sides of the outer wrapper 14 and the top and bottom sides 48, 50 extend between the first and second sides 44, 46 of the outer wrapper 14.

Referring still to FIGS. 3-8, the insulated structure 10 further includes the at least one bracket 16. The at least one bracket 16 may be coupled to at least one of the outer wrapper 14 and the inner liner 20 of the insulated structure 10. In the embodiment illustrated in FIGS. 3 and 4, the at least one bracket 16 is coupled to the outer wrapper 14 of the insulated structure 10. It is contemplated that the outer wrapper 14 and the at least one bracket 16 may be coupled to each other in a variety of manners. In some implementations, the at least one bracket 16 is welded to the outer wrapper 14 of the insulated structure 10.

In some implementations, the at least one bracket 16 is coupled to the top side 48 of the outer wrapper 14. For example, the at least one bracket 16 may include a top bracket 52 that is coupled to the top side 48 of the outer wrapper 14. The top bracket 52 can include an attachment feature 54, as illustrated in FIG. 4, upon which the hinge 40 of the door 38 of the refrigeration unit 12 is configured to be attached. The hinge 40 may be configured to pivotably couple the insulated structure 10 with the refrigeration unit 12, in some implementations. A bottom bracket 56 of the insulated structure 10 may alternatively or additionally include the attachment feature 54 for attachment of the hinge 40 to the insulated structure 10. In the embodiment illustrated in FIGS. 3 and 4, the at least one bracket 16 includes the top bracket 52 that includes the attachment feature 54 and the bottom bracket 56 opposite the top bracket 52 coupled to the bottom side 50 of the outer wrapper 14 that includes the attachment feature 54.

In various implementations, the at least one bracket 16 of the insulated structure 10 includes a plurality of brackets 16. For example, in the embodiment illustrated in FIGS. 3 and 4, the insulated structure 10 includes the top bracket 52 that is coupled to the top side 48 of the outer wrapper 14, the bottom bracket 56 that is coupled to the bottom side 50 of the outer wrapper 14, a first side bracket 58 that is coupled to the first side 44 of the outer wrapper 14, and a second side bracket 60 that is coupled to the second side 46 of the outer wrapper 14. In an exemplary embodiment, each of the top bracket 52, the bottom bracket 56, the first side bracket 58, and the second side bracket 60 are welded to the outer wrapper 14 of the insulated structure 10.

Figure 5:
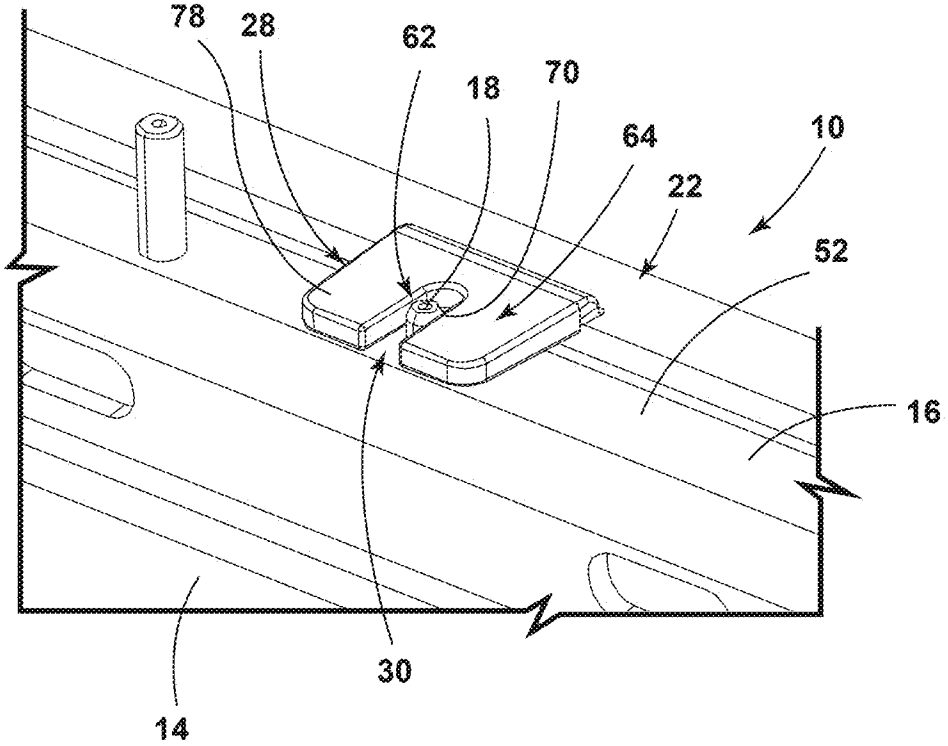
FIG. 5 is an enlarged view of area V of FIG. 3, illustrating a locator pin extending from a bracket coupled to an outer wrapper of the insulated structure and an alignment tab coupled to the trim breaker and defining a receiver that receives the locator pin therein.

Referring now to FIGS. 3-5, the at least one bracket 16 may include at least one alignment feature 62. The at least one alignment feature 62 is configured to be engaged with at least one corresponding alignment feature 64 of the trim breaker 22 in an assembled condition of the insulated structure 10, as illustrated in FIGS. 3 and 5, and as described further herein. In the embodiment illustrated in FIG. 5, the at least one alignment feature 62 coupled to the at least one bracket 16 includes at least one locator pin 18 that extends outward from the at least one bracket 16. A variety of types of alignment features 62 coupled to the at least one bracket 16 are contemplated.

Referring still to FIGS. 3-5, in some implementations, the at least one alignment feature 62 coupled to the bracket 16 includes a plurality of alignment features 62. For example, in the embodiment illustrated in FIGS. 3 and 4, the at least one alignment feature 62 includes a first locator pin 66 that extends outward from the first side bracket 58, a second locator pin 68 that extends outward from the second side bracket 60, a third locator pin 70 that extends outward from the top bracket 52, and a fourth locator pin 72 that extends outward from the bottom bracket 56. The plurality of locator pins 18 may be configured to be received within receivers 30 defined by a plurality of corresponding alignment features 64 of the trim breaker 22, as illustrated in FIGS. 3 and 4, and described further herein.

Referring now to FIGS. 3-6, the trim breaker 22 of the insulated structure 10 is configured to be coupled to the outer wrapper 14 and the inner liner 20. The trim breaker 22 includes at least one corresponding alignment feature 64 that is configured to be engaged with the at least one alignment feature 62 coupled to the at least one bracket 16 of the insulated structure 10. In various implementations, the at least one corresponding alignment feature 64 of the trim breaker 22 includes at least one alignment tab 28. As illustrated in FIG. 5, the at least one alignment tab 28 defines a receiver 30 that is configured to receive the at least one locator pin 18 extending outward from the at least one bracket 16 therein. In various implementations, the at least one corresponding alignment feature 64 may include a plurality of corresponding alignment features 64. For example, in the embodiment illustrated in FIGS. 3 and 4, the at least one corresponding alignment feature 64 includes a first alignment tab 74 that defines a receiver 30 that receives the first locator pin 66, a second alignment tab 76 that defines a receiver 30 that receives the second locator pin 68, a third alignment tab 78 that defines a receiver 30 that receives the third locator pin 70, and a fourth alignment tab 80 that defines a receiver 30 that receives the fourth locator pin 72.

Figure 8:
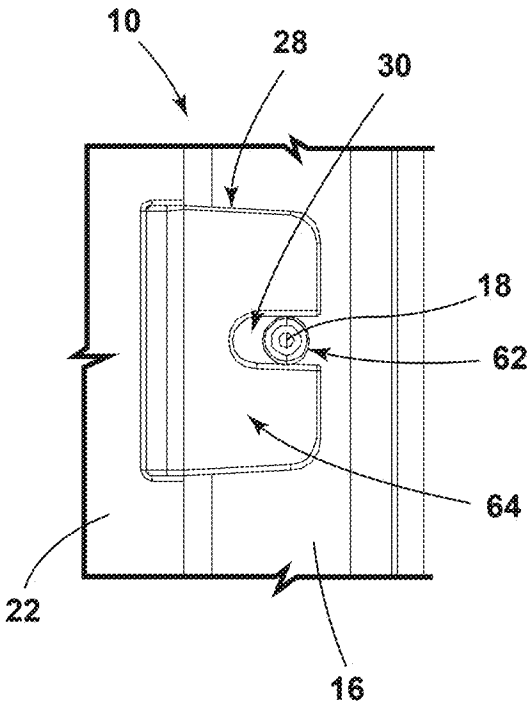
FIG. 8 is an enlarged view of a portion of an insulated structure for a refrigeration unit illustrating an alignment tab that defines a receiver coupled to a bracket of the insulated structure and a corresponding alignment feature in the form of a locator pin coupled to a trim breaker of the insulated structure and received within the receiver defined by the alignment tab.
Figure 7:
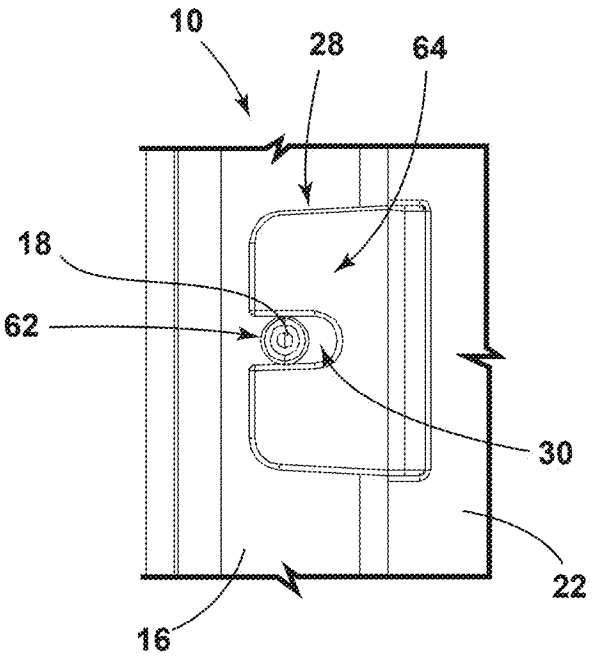
FIG. 7 is an enlarged view of a portion of an insulated structure illustrating an alignment feature in the form of a locator pin coupled to a bracket of the insulated structure and a corresponding alignment feature in the form of an alignment tab that defines a receiver coupled to a trim breaker and positioned such that the locator pin is disposed within the receiver.

Referring now to FIGS. 7 and 8, the alignment feature 62 of the at least one bracket 16 may be configured to be matingly engaged with the at least one corresponding alignment feature 64 of the trim breaker 22. In some implementations, the alignment feature 62 of the at least one bracket 16 is the locator pin 18 that extends outward from the at least one bracket 16, and the corresponding alignment feature 64 of the trim breaker 22 is the alignment tab 28 that defines the receiver 30 that receives the locator pin 18 therein, as illustrated in FIG. 7. In some implementations, the alignment feature 62 of the at least one bracket 16 is the alignment tab 28 that defines the receiver 30 and that extends outward from the at least one bracket 16, and the corresponding alignment feature 64 of the trim breaker 22 is the locator pin 18 that extends outward from the trim breaker 22 and that is received within the receiver 30 defined by the alignment tab 28, as illustrated in FIG. 8. A variety of types of alignment features 62 and corresponding alignment features 64 are contemplated.

Figure 6:
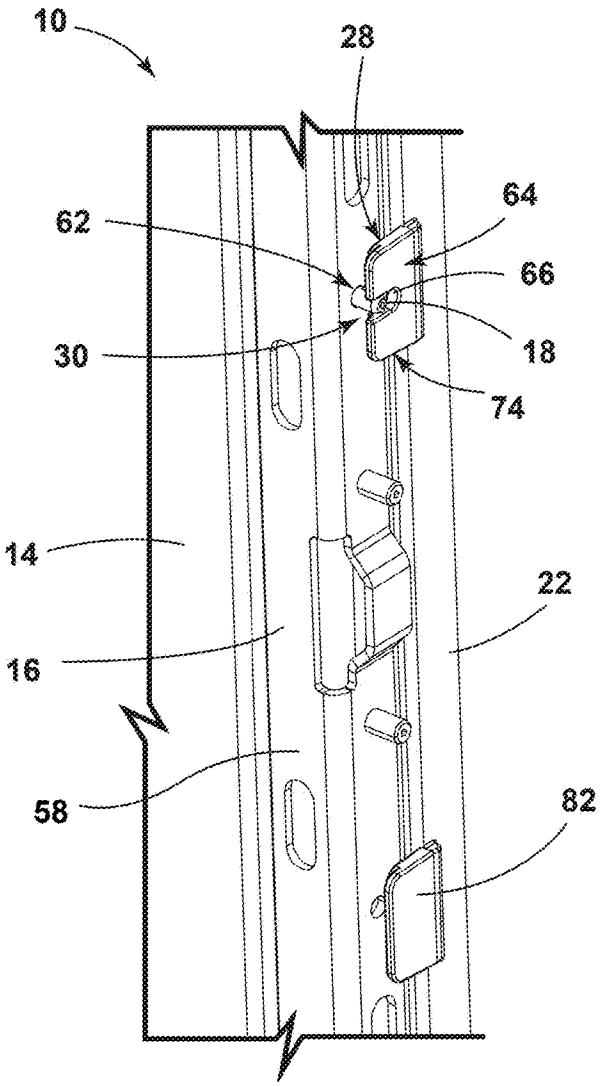
FIG. 6 is an enlarged view of area VI of FIG. 3, illustrating a locator pin coupled to a bracket received within a receiver defined by an alignment tab coupled to the trim breaker and a reference tab that is adjacent to the alignment tab and that does not define a receiver.

Referring now to FIGS. 3, 4, and 6, in some implementations, the trim breaker 22 can include a reference tab 82. The reference tab 82 may be positioned adjacent to the at least one alignment tab 28 of the trim breaker 22 and may not define the receiver 30 configured to receive the locator pin 18 extending outward from the at least one bracket 16. In various implementations, the reference tab 82 may be used as a reference point to aid in orienting the trim breaker 22 with the outer wrapper 14 and/or the inner liner 20 during assembly of the insulated structure 10. For example, in various implementations, the trim breaker 22 has a shape with symmetrical halves, such as a rectangle, which may result in the trim breaker 22 being mistakenly assembled to the outer wrapper 14 in an orientation that is rotated 180° relative to the correct orientation of the trim breaker 22 of the insulated structure 10. The reference tab 82 extending outward from the trim breaker 22 may interfere with the at least one locator pin 18 extending outward from the at least one bracket 16 coupled to the outer wrapper 14 when the trim breaker 22 is mistakenly assembled in this way. The at least one locator pin 18 that interferes with the reference tab 82 is configured to be received within a receiver 30 defined by the at least one alignment tab 28 of the trim breaker 22 during correct assembly of the insulated structure 10.

In various embodiments, wherein the trim breaker 22 includes the reference tab 82, the trim breaker 22 includes the first alignment tab 74 that defines the receiver 30 that receives the first locator pin 66, the second alignment tab 76 that defines the receiver 30 that receives the second locator pin 68, and the reference tab 82 that does not define a receiver 30 configured to receive a locator pin 18 therein in the correctly assembled condition of the insulated structure 10. In various implementations, the reference tab 82 is aligned with the first alignment tab 74 in a first direction and is aligned with the second alignment tab 76 in a second direction that is perpendicular to the first direction. For example, as is illustrated in FIG. 4, the first and second alignment tabs 28 are vertically offset from each other, and the reference tab 82 is adjacent to and aligned with the first alignment tab 74 in a vertical direction and is aligned with the second alignment tab 76 in a horizontal direction. In the embodiment illustrated in FIG. 4, the trim breaker 22 includes a plurality of reference tabs 82.

According to one aspect of the present disclosure, an insulated structure for a refrigeration unit includes an outer wrapper, at least one bracket coupled to the outer wrapper and having at least one locator pin that extends outward therefrom, an inner liner, and a trim breaker coupled to and extending between the outer wrapper and the inner liner, such that the outer wrapper, the inner liner, and the trim breaker cooperate to define an interior volume for receiving insulation material therein. The trim breaker includes at least one alignment tab that defines a receiver that receives the at least one locator pin therein.

According to another aspect, said insulated structure comprises a vacuum insulated door panel.

According to another aspect, the at least one bracket includes a top bracket coupled to a top side of the outer wrapper and having an attachment feature upon which a hinge configured to pivotably couple the insulated structure with a cabinet of said refrigeration unit is configured to be mounted.

According to another aspect, the at least one bracket further includes a first side bracket coupled to a first side of the outer wrapper, a second side bracket coupled to a second side of the outer wrapper opposite the first side, and a bottom bracket coupled to a bottom side of the outer wrapper.

According to another aspect, the at least one locator pin includes a first locator pin that extends outward from the first side bracket, a second locator pin that extends outward from the second side bracket, a third locator pin that extends outward from the top bracket, and a fourth locator pin that extends outward from the bottom bracket.

According to another aspect, the at least one alignment tab includes a first alignment tab that defines a receiver that receives the first locator pin, a second alignment tab that defines a receiver that receives the second locator pin, a third alignment tab that defines a receiver that receives the third locator pin, and a fourth alignment tab that defines a receiver that receives the fourth locator pin.

According to another aspect, the first alignment tab is vertically offset from the second alignment tab.

According to another aspect, the trim breaker further includes a reference tab that is adjacent to the first alignment tab and that does not define a receiver. The reference tab is vertically aligned with the second alignment tab and the second locator pin.

According to another aspect, the at least one bracket is welded to the outer wrapper.

According to another aspect of the present disclosure, an insulated structure for a refrigeration unit includes an outer wrapper, an inner liner, at least one bracket coupled to at least one of the outer wrapper and the inner liner and having first and second locator pins that extend outward therefrom, and a trim breaker coupled to and extending between the outer wrapper and the inner liner, such that the outer wrapper, the inner liner, and the trim breaker cooperate to define an interior volume for receiving insulation material therein. The trim breaker includes a first alignment tab that defines a receiver that receives the first locator pin, a second alignment tab that defines a receiver that receives the second locator pin, and a reference tab that does not define a receiver that receives a locator pin therein. The reference tab is aligned with the first alignment tab in a first direction and is aligned with the second alignment tab in a second direction that is perpendicular to the first direction.

According to another aspect, said insulated structure comprises a vacuum insulated door panel.

According to another aspect, the at least one bracket includes a first side bracket coupled to a first side of the outer wrapper, and a second side bracket coupled to a second side of the outer wrapper. The first locator pin extends outward from the first side bracket, and the second locator pin extends outward from the second side bracket.

According to another aspect, the first side of the outer wrapper is positioned opposite the second side of the outer wrapper.

According to another aspect, the first and second sides of the outer wrapper are lateral sides of the outer wrapper.

According to another aspect, the at least one bracket further includes a top bracket coupled to a top side of the outer wrapper that extends between the first and second sides of the outer wrapper, and a bottom bracket coupled to a bottom side of the outer wrapper that extends between the first and second sides of the outer wrapper opposite the top side. The top bracket includes a third locator pin that is received within a receiver defined by a third alignment tab that extends outward from the trim breaker, and the bottom bracket includes a fourth locator pin that is received within a receiver defined by a fourth alignment tab that extends outward from the trim breaker.

According to another aspect, the top bracket includes an attachment feature upon which a hinge configured to pivotably couple the insulated structure with a cabinet of said refrigeration unit is configured to be mounted.

According to yet another aspect of the present disclosure, an insulated structure for a refrigeration unit including an outer wrapper, an inner liner, at least one bracket coupled to at least one of the outer wrapper and the inner liner and having at least one alignment feature that extends outward therefrom, and a trim breaker coupled to and extending between the outer wrapper and the inner liner, such that the outer wrapper, the inner liner, and the trim breaker cooperate to define an interior volume for receiving insulation material therein. The trim breaker includes at least one corresponding alignment feature that is engaged with the at least one alignment feature.

According to another aspect, the at least one alignment feature of the at least one bracket is matingly engaged with the at least one corresponding alignment feature of the trim breaker.

According to another aspect, the at least one alignment feature of the at least one bracket is a locator pin that extends outward from the at least one bracket, and the at least one corresponding alignment feature of the trim breaker is an alignment tab that defines a receiver that receives the locator pin therein.

According to another aspect, the at least one alignment feature of the at least one bracket is an alignment tab that defines a receiver and that extends outward from the at least one bracket, and the at least one corresponding alignment feature of the trim breaker is a locator pin that extends outward from the trim breaker and that is received within the receiver defined by the alignment tab.

It will be understood by one having ordinary skill in the art that construction of the described disclosure and other components is not limited to any specific material. Other exemplary embodiments of the disclosure disclosed herein may be formed from a wide variety of materials, unless described otherwise herein.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An insulated structure for a refrigeration unit, comprising:

an outer wrapper;

at least one bracket coupled to the outer wrapper and having at least one locator pin that extends outward therefrom;

wherein the at least one bracket comprises:

a top bracket coupled to a top side of the outer wrapper and having an attachment feature upon which a hinge configured to pivotably couple the insulated structure with a cabinet of said refrigeration unit is configured to be mounted;

a first side bracket coupled to a first side of the outer wrapper;

a second side bracket coupled to a second side of the outer wrapper opposite the first side; and a bottom bracket coupled to a bottom side of the outer wrapper; and wherein the at least one locator pin comprises:

a first locator pin that extends outward from the first side bracket;

a second locator pin that extends outward from the second side bracket;

a third locator pin that extends outward from the top bracket; and a fourth locator pin that extends outward from the bottom bracket; and an inner liner; and a trim breaker coupled to and extending between the outer wrapper and the inner liner, such that the outer wrapper, the inner liner, and the trim breaker cooperate to define an interior volume for receiving insulation material therein, the trim breaker including at least one alignment tab that defines a receiver that receives the at least one locator pin therein and a reference tab that does not define a receiver, wherein the at least one alignment tab comprises:

a first alignment tab that defines a receiver that receives the first locator pin;

a second alignment tab that defines a receiver that receives the second locator pin;

a third alignment tab that defines a receiver that receives the third locator pin; and a fourth alignment tab that defines a receiver that receives the fourth locator pin; and wherein the first alignment tab is vertically offset from the second alignment tab; and wherein the reference tab is adjacent to the first alignment tab and vertically aligned with the second alignment tab and the second locator pin.

2. The insulated structure of claim 1, wherein said insulated structure comprises a vacuum insulated door panel.

3. The insulated structure of claim 1, wherein the at least one bracket is welded to the outer wrapper.

4. An insulated structure for a refrigeration unit, comprising:

an outer wrapper;

an inner liner;

at least one bracket coupled to at least one of the outer wrapper and the inner liner and having first and second locator pins that extend outward therefrom; and a trim breaker coupled to and extending between the outer wrapper and the inner liner, such that the outer wrapper, the inner liner, and the trim breaker cooperate to define an interior volume for receiving insulation material therein, the trim breaker including a first alignment tab that defines a receiver that receives the first locator pin, a second alignment tab that defines a receiver that receives the second locator pin, and a reference tab that does not define a receiver that receives a locator pin therein, wherein the reference tab is aligned with the first alignment tab in a first direction and is aligned with the second alignment tab in a second direction that is perpendicular to the first direction.

5. The insulated structure of claim 4, wherein said insulated structure comprises a vacuum insulated door panel.

6. The insulated structure of claim 4, wherein the at least one bracket comprises:

a first side bracket coupled to a first side of the outer wrapper; and a second side bracket coupled to a second side of the outer wrapper, wherein the first locator pin extends outward from the first side bracket, and the second locator pin extends outward from the second side bracket.

7. The insulated structure of claim 6, wherein a first side of the outer wrapper is positioned opposite a second side of the outer wrapper.

8. The insulated structure of claim 7, wherein the first and second sides of the outer wrapper are lateral sides of the outer wrapper.

9. The insulated structure of claim 8, wherein the at least one bracket further comprises:

a top bracket coupled to a top side of the outer wrapper that extends between the first and second sides of the outer wrapper; and a bottom bracket coupled to a bottom side of the outer wrapper that extends between the first and second sides of the outer wrapper opposite the top side, wherein the top bracket includes a third locator pin that is received within a receiver defined by a third alignment tab that extends outward from the trim breaker, and the bottom bracket includes a fourth locator pin that is received within a receiver defined by a fourth alignment tab that extends outward from the trim breaker.

10. The insulated structure of claim 9, wherein the top bracket includes an attachment feature upon which a hinge configured to pivotably couple the insulated structure with a cabinet of said refrigeration unit is configured to be mounted.

11. An insulated structure for a refrigeration unit, comprising:

an outer wrapper;

an inner liner;

at least one bracket coupled to at least one of the outer wrapper and the inner liner and having at least one alignment feature that extends outward therefrom;

wherein the at least one bracket comprises:

a first side bracket coupled to a first side of the outer wrapper; and a second side bracket coupled to a second side of the outer wrapper opposite the first side; and wherein the at least one alignment feature comprises:

a first alignment feature that extends outward from the first side bracket; and a second alignment feature that extends outward from the second side bracket; and a trim breaker coupled to and extending between the outer wrapper and the inner liner, such that the outer wrapper, the inner liner, and the trim breaker cooperate to define an interior volume for receiving insulation material therein, the trim breaker including at least one corresponding alignment feature that is engaged with the at least one alignment feature and at least one reference feature adjacent to the at least one alignment feature;

wherein the at least one corresponding alignment feature comprises:

a first corresponding alignment feature that engages with the first alignment feature; and a second corresponding alignment feature that engages with the second alignment feature; and wherein the at least one reference feature comprises:

a first reference feature adjacent to the first alignment feature and vertically aligned with the second alignment feature and the second corresponding alignment feature, wherein the first reference feature is configured to prevent engagement with the second alignment feature.

12. The insulated structure of claim 11, wherein the at least one alignment feature of the at least one bracket is matingly engaged with the at least one corresponding alignment feature of the trim breaker.

13. The insulated structure of claim 11, wherein the at least one alignment feature of the at least one bracket is a locator pin that extends outward from the at least one bracket, and the at least one corresponding alignment feature of the trim breaker is an alignment tab that defines a receiver that receives the locator pin therein.

14. The insulated structure of claim 11, wherein the at least one alignment feature of the at least one bracket is an alignment tab that defines a receiver and that extends outward from the at least one bracket, and the at least one corresponding alignment feature of the trim breaker is a locator pin that extends outward from the trim breaker and that is received within the receiver defined by the alignment tab.

* * * * *